US005484641A

United States Patent [19]

Rotter

[11] Patent Number: 5,484,641

[45] Date of Patent: Jan. 16, 1996

[54] PROCESS FOR FIXING PLASTIC REINFORCING PINS INTO NON-WOVEN FILAMENTARY MATERIAL AND PRODUCT PRODUCED BY THE PROCESS

[76] Inventor: Martin J. Rotter, 115 Lismore Ave., Glenside, Pa. 19038

[21] Appl. No.: 145,931

[22] Filed: Nov. 1, 1993

[51] Int. Cl.[6] ..... D04H 1/58; D04H 1/66

[52] U.S. Cl. ..... 428/139; 156/253; 156/270; 156/291; 264/128; 264/154; 428/288

[58] Field of Search ..... 156/167, 252, 156/253, 270, 291, 305, 513; 428/67, 137, 138, 139, 140, 296, 288; 52/309.2; 264/118, 128, 137, 154, 155, 156; 425/290; 427/288, 424

[56] References Cited

U.S. PATENT DOCUMENTS

| | | | |
|---|---|---|---|
| 949,863 | 2/1910 | Traeber et al. . | |
| 1,960,881 | 5/1934 | Sunbury | 18/1 |
| 2,078,801 | 4/1937 | Lewis | 18/1 |
| 2,688,152 | 9/1954 | Marco | 18/4 |
| 2,704,067 | 3/1955 | Moses | 128/90 |
| 2,934,790 | 5/1960 | Shwayder | 18/56 |
| 3,034,174 | 5/1962 | Kranc et al. | 18/27 |
| 3,073,714 | 1/1963 | Shu-Tung Tu et al. | 428/139 |
| 3,216,167 | 11/1965 | Roberts et al. | 428/140 |
| 3,234,593 | 2/1966 | Lerner et al. | 18/1 |
| 3,345,241 | 10/1967 | Shannon | 156/291 |
| 3,350,249 | 10/1967 | Gregoire | 156/253 |
| 3,451,885 | 6/1969 | Klein | 161/80 |
| 3,517,410 | 6/1970 | Rapisarda | 18/1 |
| 3,640,655 | 2/1972 | Wallace | 425/109 |
| 3,743,458 | 7/1973 | Hallauer et al. | 425/122 |
| 3,841,933 | 10/1974 | Fleissner | 156/148 |
| 3,878,283 | 4/1975 | Jones, Sr. | 264/152 |
| 3,892,621 | 7/1975 | Salonen | 156/513 |
| 4,038,356 | 7/1977 | Beranek, Jr. et al. | 264/160 |
| 4,217,387 | 8/1980 | Viezee et al. | 156/167 |
| 4,235,584 | 11/1980 | Yunoki | 425/545 |
| 4,345,889 | 8/1982 | Sizemore et al. | 425/122 |
| 4,456,576 | 6/1984 | Cotte | 264/255 |
| 4,555,227 | 11/1985 | Ditscheid | 425/122 |
| 4,705,469 | 11/1987 | Liebl et al. | 425/117 |
| 4,728,477 | 3/1988 | Dromigny | 264/509 |
| 4,766,024 | 8/1988 | Nath et al. | 428/139 |
| 4,784,591 | 11/1988 | Ackermann | 425/116 |
| 4,857,381 | 8/1989 | Suzuki | 428/120 |
| 4,886,632 | 12/1989 | Van Iten et al. | 264/156 |
| 5,017,320 | 5/1991 | Garcia | 264/148 |
| 5,066,531 | 11/1991 | Legg et al. | 264/154 |
| 5,145,691 | 9/1992 | Kawakami et al. | 425/110 |
| 5,167,579 | 12/1992 | Rotter | 454/365 |
| 5,185,115 | 2/1993 | Held | 264/83 |
| 5,425,672 | 6/1995 | Rotter | 454/365 |

FOREIGN PATENT DOCUMENTS

| | | | |
|---|---|---|---|
| 2611931 | 9/1977 | Germany | 425/290 |
| 222265 | 8/1992 | Japan | 264/156 |
| WO93/04323 | 3/1993 | WIPO . | |

*Primary Examiner*—Steven D. Maki

*Attorney, Agent, or Firm*—Panitch Schwarze Jacobs & Nadel

[57] ABSTRACT

A method of fixing plastic reinforcing pins into non-woven filamentary material includes the steps of: (a) providing an elongated web of randomly-aligned synthetic fibers, (b) creating a repeating pattern of holes through the by a hole-punching mechanism having a plurality of heated punch heads maintained at a temperature above the melting point of the synthetic fibers, (c) conveying the web from the punching mechanism over a supporting belt such that the belt provides a closed bottom for each hole, (d) injecting a quick-setting liquid polymer into the holes with an injector mechanism having a plurality of liquid injector nozzles arranged in an identical pattern as the pattern of punch heads and operated in coordinated sequence with the punching mechanism, such that an injector nozzle is inserted into a corresponding hole, and (e) allowing the severed ends of the fibers to imbed into the liquid polymer before it sets. The liquid polymer may be created by mixing a quick-setting liquid resin and cross-linking hardening agent just prior to injection into the holes and supplying the mixture to each nozzle.

The invention also includes a non-woven filamentary material having plastic reinforcing pins fixed into it by this process.

4 Claims, 2 Drawing Sheets

PROCESS FOR FIXING PLASTIC REINFORCING PINS INTO NON-WOVEN FILAMENTARY MATERIAL AND PRODUCT PRODUCED BY THE PROCESS

FIELD OF THE INVENTION

This invention is related to the general field of non-woven filamentary materials, particularly materials in which synthetic fibers are randomly-aligned in a web and bonded together at their intersections to produce an open-mesh material having high tensile strength in all directions. It is related to the specific field of reinforcing such randomly-aligned web materials against deformation under compressive force, herein by a process of injecting liquid polymer into the web to form plastic reinforcing pins which are bonded to the synthetic fibers.

BACKGROUND OF THE INVENTION AND DESCRIPTION OF RELATED ART

Non-woven random web filamentary materials are well known and provide useful physical properties over woven or oriented webs. In general, randomly aligned filaments form a web material with an open convoluted mesh that can be useful in ventilating and filtering, but have an essentially equal strength in both lateral and transverse directions that is not found in other bonded webs where the filaments are oriented in particular direction.

Although there may be various techniques for producing randomly oriented webs, a common technique is by using commercial machines called a Rando-Feeder and Rando-Webber, which operate together to separate the filaments and trap them in random alignment (a more detailed description is given in *Man-Made Fibers*, sixth edition, by R. W. Moncrief, at pages 774–5). The randomly aligned filaments are then bonded together at their intersections by adhesive binding agents, or by thermoplastic or solvent bonding of the fibers themselves. Generally the filaments are synthetic fibers, and the particular synthetic material and its denier is selected to meet the requirements for the particular application in which the web will be used. Similarly, the binding agent or agents are chosen to suit the application.

For example, in U.S. Pat. No. 5,167,579 by this inventor, a unitary mat of such randomly aligned material is disclosed for use in a roof ridge vent. The fiber material and its denier, the binder, fiber percentage and other parameters of that mat were chosen to suit the requirements of providing adequate ventilation, acting as a water and insect barrier, resisting deterioration for approximately the life of the roof under normal environmental conditions, and supporting the cap shingles. Other applications, such as packaging liners, pressure filters, heat exchange liner, splash block in cooling towers, battery plate separators, pallet separators, sound attenuators, etc., may dictate a different choice of materials.

While a random web material is frequently useful because it can provide a relatively open mesh without sacrificing lateral and transverse tensile strength, it generally will not resist compressive forces to the same extent. That is, it is more easily compressed than stretched or ripped apart. This may be a constraint in applications where the material is subjected to significant compressive force. For example, in the application of a roof ridge vent, the mat of randomly aligned material is relatively thin (⅝") to create a low-profile appearance of the capping shingles along the ridge, yet is sufficiently air permeable to permit the necessary ventilation. With asphalt shingles or other relatively light capping elements, even when covered by snow, the weight on the mat will not compress the material to any significant extent which might interfere with ventilation flow. However, if very heavy slate or stone tiles are used as the ridge cap, the material may compress to the extent that the ventilation is restricted, unless the thickness of the mat were increased, or a larger denier fiber and stiffer binding agents selected to support the heavier weight. Similarly, if the material is used as a pallet separator to cushion and ventilate between heavy cargo pallets, it must resist severe compressive while retaining an open mesh for ventilation. In these and other applications, it would be advantageous to provide an essentially compression-proof random web material.

This invention is related to the compression resistant solution disclosed in international application PCT/US92/06658 by this inventor, wherein solid nylon cores are injected into the vent mat at spaced intervals to form a support grid to carry the weight of slate capping tiles. In particular, this invention is directed to a method of injecting quick-setting liquid polymer into the filamentary web materials to form plastic pins which are bonded to the filaments.

SUMMARY OF THE INVENTION

A method of fixing plastic reinforcing pins into non-woven filamentary material includes the steps of: (a) providing an elongated web of randomly-aligned synthetic fibers, (b) creating a repeating pattern of holes through the web by a hole-punching mechanism having a plurality of heated punch heads maintained at a temperature above the melting point of the synthetic fibers, (c) conveying the web from the punching mechanism over a supporting belt such that the belt provides a closed bottom for each hole, (d) injecting a quick-setting liquid polymer into the holes with an injector mechanism having a plurality of liquid injector nozzles arranged in an identical pattern as the pattern of punch heads and operated in coordinated sequence with the punching mechanism, such that an injector nozzle is inserted into a corresponding hole, and (e) allowing the liquid polymer to flow around the severed ends of the fibers to imbed said ends into the polymer as it sets. The .liquid polymer may be created by mixing a quick-setting liquid resin and a cross-linking or other hardening agent just prior to injection into the holes and supplying the mixture to each nozzle.

The invention also includes a non-woven filamentary material having plastic reinforcing pins fixed into it by this process.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION AND A PREFERRED MODE

This process is intended to permit automated mass production of pin-reinforced randomly-aligned synthetic fiber web in rolls for convenient packaging and transportation to a work site for later cutting to desired length. Consequently, for purposes of example, the process is described herein for producing a roll of such web having a 100 foot un-rolled length, 32-inch width, and ⅝th-inch thickness. It will be apparent from the description of the process that it can be easily modified to produce reinforced web of different dimensions.

The process begins with the provision of an elongated web of randomly-aligned synthetic fibers bonded together at their intersections. For purpose of example, the process is described herein as starting with a web of 200 denier polyester fibers randomly-aligned by airflow in a commercial Rando-webber machine and bonded at their intersections by spraying a dispersion of water-based phenols and latexes onto the web and oven-curing to coat the fibers and adhesively bind them to each other at their intersections. The fiber and binder content is selected to produce a web of approximately 45 ounce-weight per square yard, of which the binder contributes approximately 25%. This web is of a size and density suitable for use as a roof ridge vent under asphalt shingles. It will be apparent from the description of the process that it can be easily modified to produce reinforced web of different materials and densities for other applications.

Figure 1:
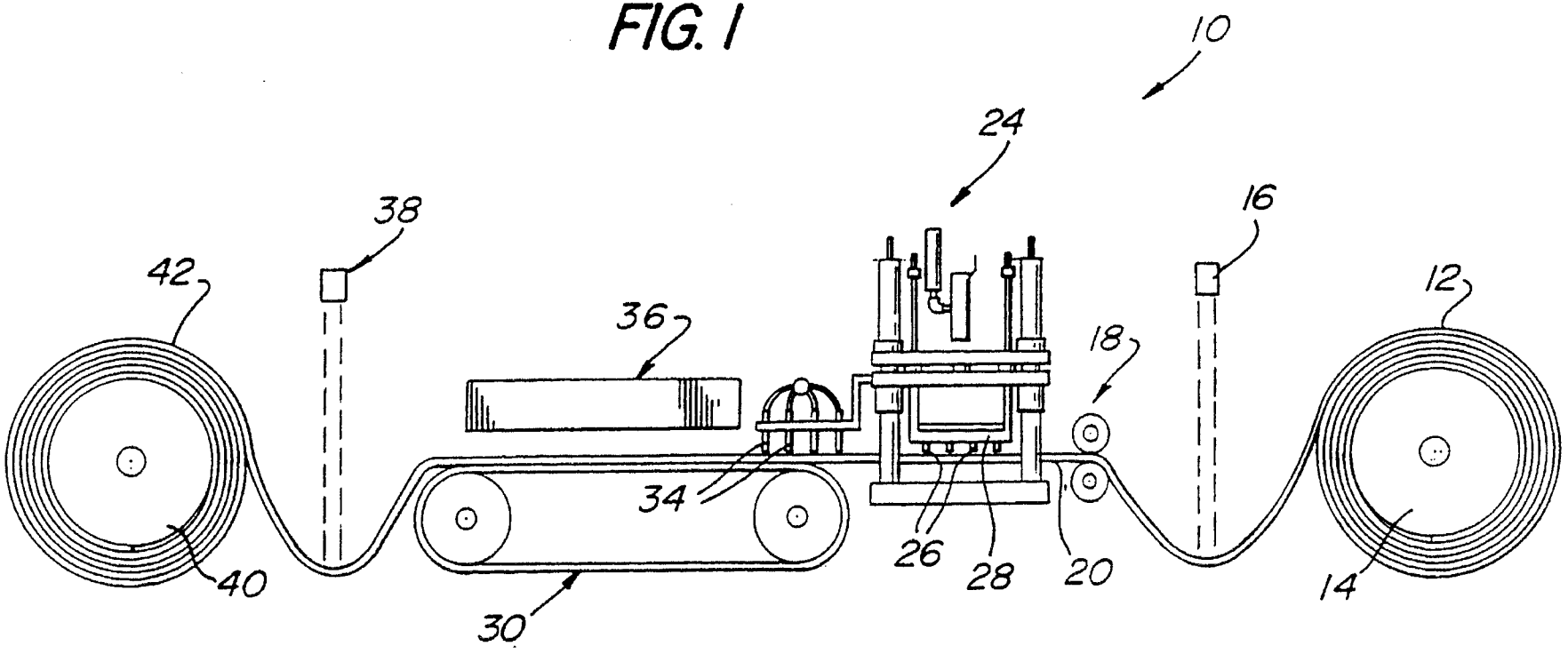
FIG. 1 is a schematic depiction of a processing line for carrying out one embodiment of the process.

The process is described in the context of having obtained the un-reinforced web in a roll of the above length. It will be apparent that if the process is conducted at a facility which manufactures the unreinforced material, the process may be added as a subsequent step to an essentially continuous web which is rolled and cut after the pins are inserted. Consequently, FIG. 1 depicts a process line (10) wherein the roll (12) of un-reinforced web is placed on a powered unwind stand (14). A sonic distance sensor (16), controls the drive motor to the unwind stand to keep a slack loop of web material between roll and feed rollers (18) of the punching mechanism.

Figure 2:
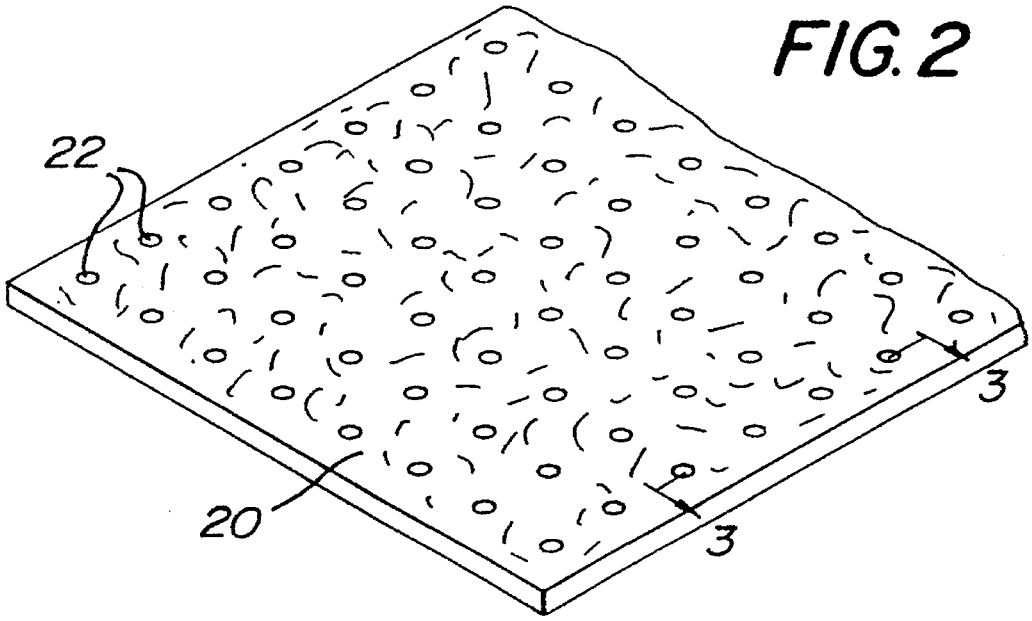
FIG. 2 is a perspective view of a web of pin-reinforced randomly-aligned synthetic fiber produced by the process.

The pin spacing pattern and pin diameter are determined according to the intended end use of the reinforced material. For purpose of this example, a repeating 4-inch square pattern of pins having a nominal ½-inch diameter is used. The pattern is centered across the web (20) and repeated across and along it as depicted in FIG. 2; that is, eight (8) pins (22) are disposed in a row transversely across the 32-inch width, the first placed 2-inches in from a lateral edge and the others spaced at 4-inch centers, wherein the eighth pin will locate 2-inches from the opposite lateral edge, giving a symmetrical web. Subsequent rows are placed at 4-inch centers behind preceding row, resulting in the repeating 4-inch square pattern. It will be apparent from the description of the process that it can be easily modified to produce different pin spacing and pin diameters for other applications.

Once the pin spacing and diameters are chosen, the process uses a hole-punching mechanism (24) having a plurality of heated punch heads (26) arranged in the selected pattern to create holes through the thickness dimension of the web. In this example, the process is described as using a vertically reciprocating platen (28) having thirty-two (32) punch heads (26) arranged in an 8-column, 4-row repetition of the 4-inch square pattern. The punch heads are metal pins of sufficient length to burn through the ⅝th-inch web without bringing the platen too close to the upper face of the web and melting or softening the web except at the holes. While this is dependant upon the thickness and melting point of the web material, the example herein using 3-inch length punch heads will keep the platen more than 2-inches above the top face of the web and should be adequate for most materials. In addition, the punch heads may have a diameter slightly smaller than the ½-inch diameter of the reinforcing pins to facilitate the ends of the severed fibers being bonded in the pins, as will be described in later paragraphs.

The platen (28) is resistance heated to maintain the temperature of the punch heads above the melting point of the synthetic fibers and binder material. Thus, the platen can be reciprocated at regular periodic intervals to punch the heads through the web and sever the fibers in contact with the heads, creating the desired holes. Although mechanical cutting punches could conceivably be used to punch the holes, heated punches have several advantages. Mechanical cutting tends to tear the fibers near the hole, opening the mesh near the hole and leaving behind the residue of cut-away fiber and binder. With thermal punching, the melted residue tends to adhere to the fiber ends near the hole, which aids maintaining the liquid resin in the hole and assists binding of the severed fiber ends into the reinforcing pin as the resin sets. Thermo-couple sensors may be used to regulate platen temperature by controlling the current to the resistance heaters.

The web is moved through the punching mechanism in incremental steps such that the 32 hole pattern is punched, then the material is indexed through the mechanism to place the front row of the punch four inches behind the last row of holes. In this example the material is fed into and indexed through the punch mechanism by a set of pinch rolls (18) powered by a programmable drive to give precise control over the roller rotation.

The punched web is then conveyed from the punching mechanism over a supporting belt (30) coated with a non-stick material (Teflon). The belt provides a closed bottom of non-stick surface for each hole, so that a quick-setting liquid polymer can be injected into the holes and not run out the bottom. In this example the web is conveyed under an injection molding machine (32) having 32 injector nozzles (34) arranged in an identical 8-column by 4-row pattern as the pattern of punch heads. The molding machine is spaced from the punching mechanism and vertically reciprocated in coordinated sequence with the punching mechanism such that an injector nozzle is inserted into a corresponding hole after the web is indexed forward. The injector nozzles are supplied with a quick-setting liquid polymer, such as by mixing a liquid resin and cross-linking or hardening agent(s) just prior to injection. In this example, a two-component polyurethane identified as Dexter N.B. 2593-68 in sufficient volume to fill a ½×⅝ inch hole will gel in about 45 seconds at 25° C. sufficiently that it will be retained in the hole without the teflon coated bottom belt. Gel times of short duration are required to have a reasonably rapid manufacturing process without an excessively long support belt. A vent hood (36) may be provided over the web as it is conveyed from the injectors if the particular liquid polymer gives off any harmful vapor as it gels. The liquid polymer components may be metered and/or mixed in any suitable metering and mixing system which gives sufficient proportional metering and mixing speed.

The injector nozzles have a diameter less than or essentially equal to that of the holes. When the nozzles are inserted into the holes, the severed ends of the fibers which extend into the hole may be pushed back. The nozzles withdraw from the holes as they inject the liquid polymer. The melted filament and binder around the holes is sufficient to contain the relatively viscous liquid ejected from flowing away laterally through the mesh, but the liquid is sufficiently viscous that the severed filament ends imbed in the polymer as it sets.

When the polymer is fully cured, it forms a generally cylindrical reinforcing pin which is bonded to the filament ends. Complete curing may take place over 12 to 24 hours, but the web material may be rolled once the polymer has set.

Figure 3:
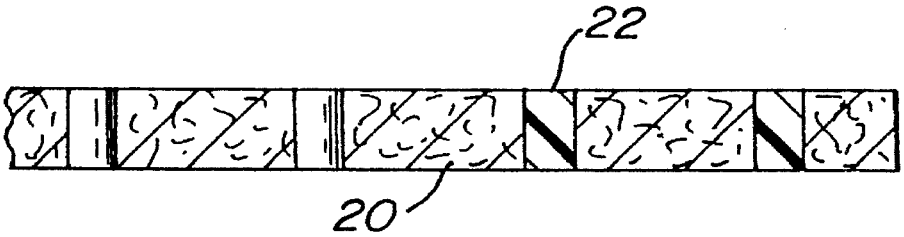
FIG. 3 is a section view of the web of pin- reinforced randomly-aligned synthetic fiber produced by the process taken along the lines 3—3 in FIG. 2.

FIG. 3 shows a section through the web material wherein the four holes shown are two rows of one index group and two rows of another index group. The holes of the first index group have received the quick-setting liquid polymer to form the cylindrical reinforcing pin. The two holes from the other index group have been formed by the heated punch heads (26) but have not been indexed, as part of the next four rows, to receive the polymer.

In the line depicted in FIG. 1, a second sonic distance sensor (38) controls the drive motor of a winding stand (40) to keep a slack loop of web material between end of the conveyor belt and the winding stand to allow the web to be formed in a roll (42). The roll may then be packaged and shipped.

The present invention may be embodied in other specific forms without departing from the spirit or essential attributes thereof and accordingly, reference should be made to the appended claims, rather than to the foregoing specification, as indicating the scope of the invention.

What is claimed is:

1. A method of fixing plastic reinforcing pins into non-woven filamentary open-mesh material comprising the steps of:

a. providing an elongated open-mesh web of randomly-aligned synthetic fibers bonded together at their intersections by a binder, said web having a length dimension beginning at a front edge and terminating at a back edge, and having an essentially constant thickness dimension;

b. creating a repeating pattern of generally cylindrical holes through the thickness dimension of the web by:

(i) passing the web from front edge to back edge through a hole-punching mechanism having a plurality of heated punch heads of generally cylindrical cross section arranged in said pattern, (ii) maintaining the temperature of the punch heads above the melting point of the synthetic fibers and the binder, (iii) periodically operating said punching mechanism to push the heads through the web, to sever the fibers in contact therewith and to form melted residue, such that ends of the severed fibers are left in the vicinity of each hole and the melted residue adheres to the fiber ends near each hole;

c. conveying the elongated web from the punching mechanism over a supporting belt such that the belt provides a closed bottom for each hole;

d. injecting a liquid polymer into the holes;

e. allowing the liquid polymer to flow around the severed ends of the fibers to embed said ends into the polymer and allowing the liquid polymer to set wherein the melted residue, which is adhered to the fiber ends, maintains the liquid polymer in the hole as it sets.

2. A method as in claim 1, in which the step of injecting a liquid polymer into the holes includes the sub-steps of:

(i) conveying the web under an injector mechanism having a plurality of liquid injector nozzles arranged in an identical pattern as the pattern of punch heads;

(ii) mixing a liquid polymer resin and hardening agent, (ii) supplying said mixture to each nozzle, (iii) periodically operating said injector mechanism in coordinated sequence with the punching mechanism such that an injector nozzle is inserted into a corresponding hole, and (iv) injecting a quantity of said mixture from each nozzle sufficient to fill the hole.

3. A non-woven filamentary material having plastic reinforcing pins fixed into the material by the process of claim 1 or claim 2.

4. A method as in claim 2, in which the step of injecting a liquid polymer into the holes includes the further sub-step of gelling in approximately 45 seconds the mixture of liquid polymer resin and hardening agent in the cylindrical hole of the web for retention in the hole.

* * * * *